United States Patent [19]

Picozza

[11] Patent Number: 4,478,450

[45] Date of Patent: Oct. 23, 1984

[54] CARRIER WITH HANDLE FOR CONTAINERS OR THE LIKE

[75] Inventor: Augusto A. Picozza, Johnston, R.I.

[73] Assignee: Dart Industries Inc., Northbrook, Ill.

[21] Appl. No.: 395,165

[22] Filed: Jul. 6, 1982

[51] Int. Cl.[3] ..... A47J 45/07; B65D 25/28

[52] U.S. Cl. ..... 294/31.2; 220/94 R; 294/165

[58] Field of Search ..... 294/27 R, 27 H, 31.2, 294/137, 149, 151-157, 165, 167, 169, 170; 16/114 R, 125; 220/94 R, 94 A, 96

[56] References Cited

U.S. PATENT DOCUMENTS

| | | | |
|---|---|---|---|
| 1,327,680 | 1/1920 | Leahy | 294/153 |
| 2,371,639 | 3/1945 | Mason | 16/125 |
| 2,654,115 | 10/1953 | Kafer | 16/125 |
| 2,800,940 | 7/1957 | Riesebeck | 150/12 |
| 3,654,049 | 4/1972 | Ausnit | 161/7 |
| 3,886,633 | 6/1975 | Ausnit | 24/201 C |
| 3,918,131 | 11/1975 | Ausnit | 24/201 C |
| 4,207,997 | 6/1980 | Croyle | 224/55 |

*Primary Examiner*—Johnny D. Cherry
*Attorney, Agent, or Firm*—A. Lewis Worthem, Jr.

[57] ABSTRACT

A container encircling frame with opposed pairs of resiliently deformable straps extending therefrom. Each pair of straps mounts an elongated handle element transversely across the outer ends thereof, the two handle elements, upon a releasable interlocking thereof, defining a single handle or hand grip. Each handle element includes a vertical ribbed panel, with a laterally spaced lip defining a recess for the panel of the other handle element. Interlocking is effected through releasably engageable detents and projections on the panels and lips.

13 Claims, 12 Drawing Figures

64
78
60
58
36
40
38
20
32
30
34
82
74
44

CARRIER WITH HANDLE FOR CONTAINERS OR THE LIKE

BACKGROUND OF THE INVENTION

The invention herein relates to carrying apparatus, more particularly a carrier for personal sized objects, such as food containers or the like, which can be selectively engaged by the carrier and subsequently released therefrom.

Carriers of this general type are known, as exemplified by the following patents:

No. D.254,170 issued Feb. 12, 1980

No. 4,207,997 issued June 17, 1980

Of particular note with regard to U.S. Pat. No. 4,207,997 is the extensive discussion therein relative to the advantages of and limitations in detachable carriers. The disclosure of this patent is herein incorporated by reference.

One particular advantage of such carriers is the elimination of individual handles on individual containers. Rather, a single carrier is used to sequentially accommodate any number of containers. This in turn provides for more compact containers which facilitates container storage and results in substantial savings in materials and manufacturing procedures.

Limitations of such carriers generally involve difficulties in properly engaging the carrier with the container to provide for a positive support of the container while allowing substantially free access to the container, and in particular the loading end thereof, whether open or covered.

Another area of potential difficulty is the handle itself, particularly with regard to those carriers wherein the handle is formed of multiple elements which, during use, are to be manually retained or mechanically interlocked into a single handle or hand grip.

SUMMARY OF THE INVENTION

A primary object of the invention is to provide an improved carrier of the type adapted to engage with a container or the like for a convenient manual transport or handling of the container, and, after use, ready disengage for subsequent reuse.

The carrier includes an endless frame adapted to receive a container therein with the frame being sized relative to the container to either frictionally engage therewith or appropriately seat beneath a peripheral flange-like portion thereon whereby complete movement of the container through the frame is precluded. Strap means extend from opposed portions of the frame and, through a degree of flexure inherent therein, are adapted to be swung upwardly and over the frame received container. The strap means, in each instance, mount an elongated rigid handle element. The handle elements, in turn, are adapted for releasable interlocking into a single handle or hand grip which is rigidified by internal ribbed panels, provided with external grip enhancing grooves in conjunction with a generally smoothly contoured projection-free surface, and incorporate interfitting projections and detents interlocking the handle elements in a manner whereby the load introduced into the carrier during the normal use thereof will enhance the engagement.

The handle elements are identical, one inverted relative to the other. Each element includes an elongated body extending between strap-mounted end blocks. The body includes a full length transversely arcuate grooved surface terminating at a longitudinally extending planar shoulder from which a full length vertically extending ribbed panel projects. A full length lip, of a lateral curvature corresponding to the arcuate grooved surface of the body, is integrally formed with the body to the opposite side of the partition, defining a vertically directed recess for nested reception of the panel of the companion handle element. Upon a nesting of the handle elements the arcuate lip of each element directly engages the shoulder of the other element and forms a smooth continuation of the arcuate body wall. Each panel has a series of detents formed therein which cooperate with projections provided on the lips of the companion elements for a snap locking of the elements together on a seated engagement of the panels within the respective recesses.

Further and more specific objects and advantages of the invention will occur to those skilled in the art upon consideration of the following detailed description thereof taken in conjunction with the drawings.

DESCRIPTION OF PREFERRED EMBODIMENT

Figure 7:
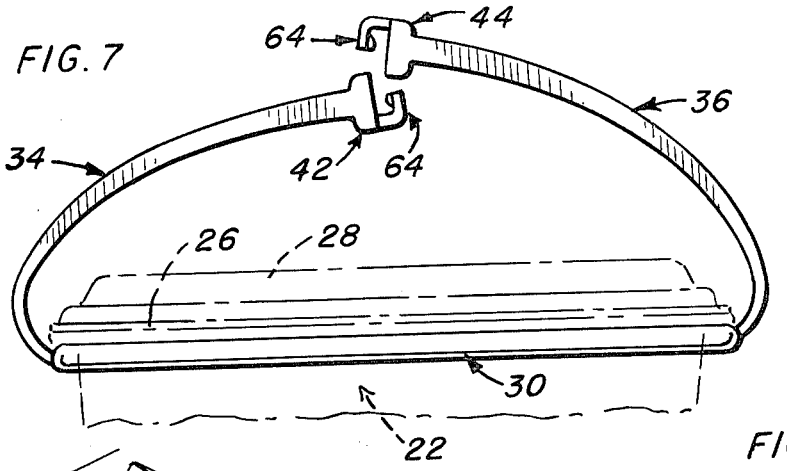
FIG. 7 is a side elevational view of the carrier just prior to engagement of the handle elements.
Figure 12:
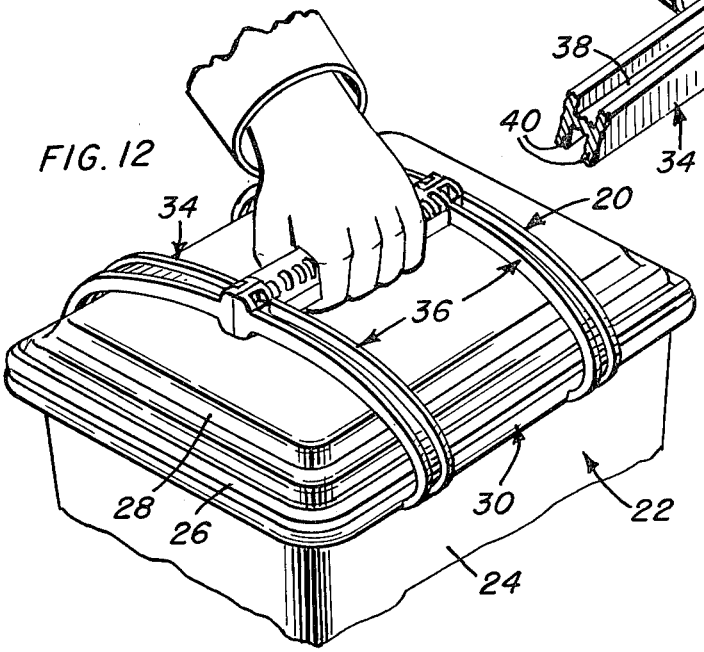
FIG. 12 is a perspective detail of the carrier in use.

Referring now more specifically to the drawings, reference numeral 20 has been used to designate the carrier comprising the present invention. The carrier, as will be appreciated from FIGS. 7 and 12 in particular, is specifically intended for detachable engagement with a container 22 for a selective lifting and carrying thereof. In the illustrated embodiment, the container 22 is of generally rectangular configuration with vertical or somewhat upwardly and outwardly divergent side walls 24, an open top surrounded by a peripheral flange 26, and, if so desired, a closure or lid 28.

The carrier 20 includes an endless frame 30 defined, preferably, by a continuous cylindrical rod-shaped member incorporating inwardly enlarged inner corner portions 32 providing additional rigidity at the corners of the frame in conjunction with vertical container guiding faces. As will be appreciated, the configuration of the frame 30 is to compliment the walls of the container received therein. While the frame, in use of the carrier, will normally engage the undersurface of the container flange 26, with a tapered wall container, the frame, rather than engaging the undersurface of the flange 26, may engage the container walls themselves for both a confining and a support of the container 22. Similarly, it is to be appreciated that while the carrier 20 has been illustrated with a rectangular container receiving frame 30, the invention also contemplates carriers with frames of other configurations dictated by the particular containers to be engaged therein.

Figure 1:
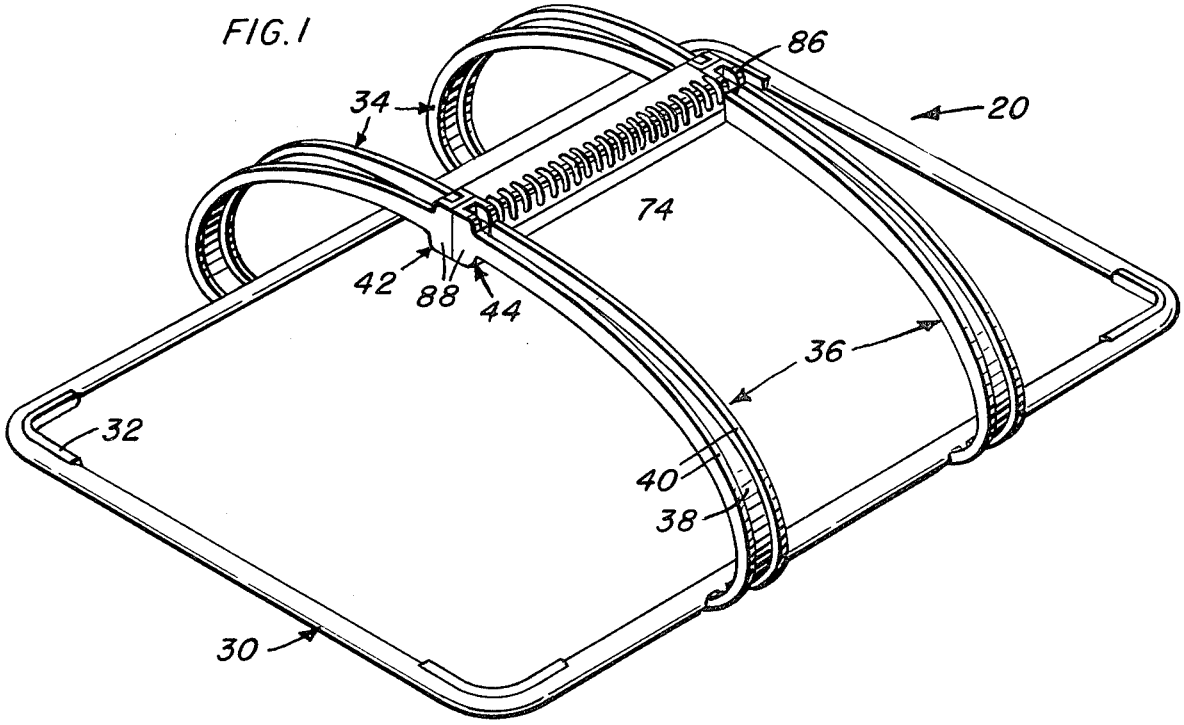
FIG. 1 is a perspective view of a carrier constructed in accordance with the teachings of the present invention with the handle elements interlocked, as it would appear when engaged with a container.

A first pair of laterally spaced straps 34 are integrally formed along the central portion of one side of the frame 30. A similar pair of laterally spaced straps 36 are aligned with the first pair of straps 34 and integrally formed with the opposed side of the frame. The straps 34 and 36 are flexible or flexibly resilient and adapted for flexing between the completely opened position of the carrier, as in FIGS. 4–6, wherein the straps are substantially coplanar with the frame 30, and a carrying position wherein the straps are folded upward and over the upper portion of the frame received container 22, as in FIGS. 1 and 12.

Figure 2:
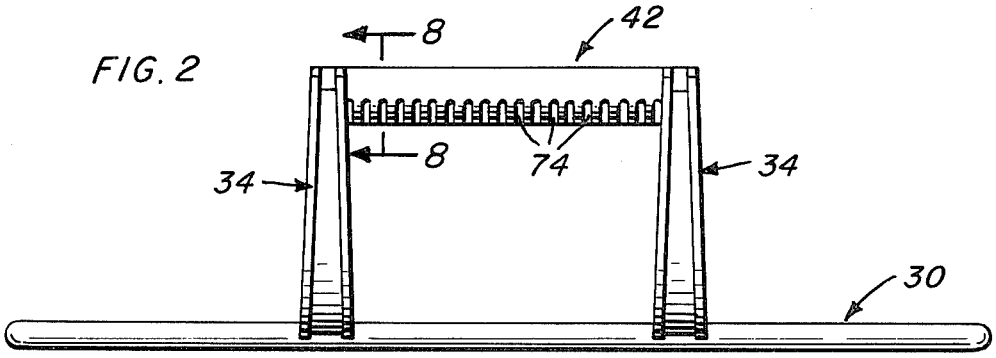
FIG. 2 is a side elevational view of the carrier of FIG. 1.
Figure 3:
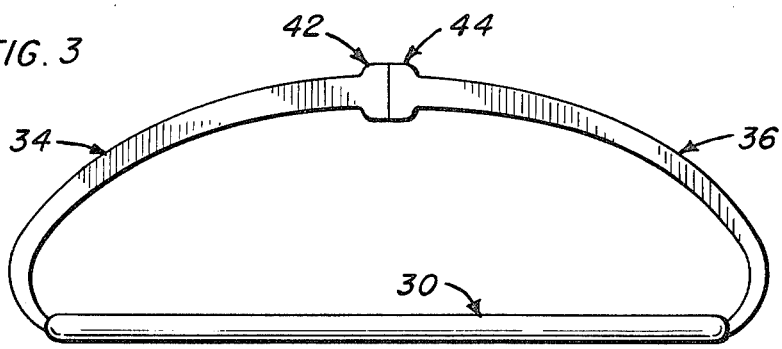
FIG. 3 is an end elevational view of the carrier of FIG. 1.

Each of the straps 34, 36 is of a generally H-shaped cross-section with a planar central web 38 and opposed side flanges 40 projecting both above and below the web 38 and constituting a significant reinforcing therefor. Noting FIGS. 2 and 4, it will be appreciated that the straps, in plan view, taper from a maximum width at the point of joinder to the frame to a minimum width remote therefrom. Similarly, noting the side elevational views of FIGS. 3 and 5, it will be appreciated that each strap, and more particularly the side flanges 40 thereof, taper from a minimum height adjacent the frame to a maximum height at the narrower remote end of the strap. Configured in this manner, the ability of the straps to flex, particularly in the immediate vicinity of the frame 30, is enhanced while the strength thereof is assured by both the relatively greater width adjacent the point of major flexure, and the relatively greater thickness toward the remote ends of the straps at which the actual lifting force is to be applied.

Actual manual engagement with the carrier is effected through a pair of complimentary handle elements 42 and 44 respectively engaged between the free or remote ends of the first pair of straps 34 and the second pair of straps 36. The handle elements are structurally identical with one element inverted relative to the other for a snap interlocking therewith in a manner forming a single gripping handle or rod with a slightly rounded cross-sectional configuration.

For purposes of description, attention is directed to the lower handle element 42, that element integrally formed with and engaged between the remote ends of the straps 34. This handle element 42 includes an elongated body 46 having a planar lower surface 48 which, through an arcuate lower, inner edge portion 50, merges into a vertical inner surface 52 which terminates in a horizontal shoulder 54. If desired to facilitate disassembly, the corner edge between the vertical inner surface 52 and the horizontal shoulder 54, as at 56, can be notched or otherwise slightly recessed.

Figure 9:
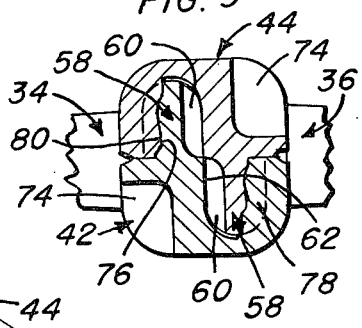
FIG. 9 is an enlarged cross-sectional detail through the engaged handles, taken on a plane passing along line 8—8 in FIG. 2.
Figure 11:
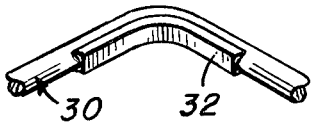
FIG. 11 is a perspective detail of one corner of the carrier frame.

Extending from the shoulder 54, along the full length thereof and inwardly spaced from the edge 56, is a vertically oriented partition or panel 58. This panel 58 includes vertical laterally projecting rigidifying ribs 60 arranged in spaced pairs along the length thereof with the ribs 60 of each pair extending from opposite vertical faces of the panel 58. The ribs 60 have vertical outer faces and arcuate upper ends which, as will be appreciated from the cross-sectional view of FIG. 9 are configured to combine with the slightly rounded upper edge of the panel 58 to form a continuously rounded cross-sectional configuration. The ribs 60 on the outer face of the panel 58, that is the face remote from the shoulder 54, have the vertical outer faces thereof coplanar with the outer wall face 62 of the body 46 immediately therebelow.

A full length lip 64 projects outwardly, and arcuately curves upwardly, from the outer vertical wall face 62 of the body 46 adjacent the lower end thereof. The lip 64 terminates at an upper edge 66 substantially coplanar with the shoulder 54 and in outwardly spaced relation to the wall face 62 to define a full length recess which, in size and configuration, compliments the ribbed panel 58, as will be best appreciated from the nested handle elements 42 and 44 best seen in FIG. 9. The outer surface of the lip 64 includes an arcuate lower edge 68 and a vertical wall face 70, defining a contour configuration substantially identical to that defined by the body surfaces 48, 50 and 52. The thickness of the lip 64 is equal to the depth of the shoulder 54 between the outer edge thereof and the vertical faces of the panel ribs 60 vertically rising therefrom. Further, the elongated corner juncture between the upper edge 66 of the lip 64 and the vertical surface thereof can be beveled or recessed, as at 72, similar to the corner recess 56 on the shoulder, for cooperation therewith in defining means to assist in manually disengaging the handle elements when desired.

The body 46 is provided with a plurality of grip enhancing grooves 74 at equally spaced points along the length thereof. These grooves are vertically defined within the body 46 through the inner surface 52, adjoining arcuate edge 50 and the adjacent portion of the body lower surface 48.

Figure 10:
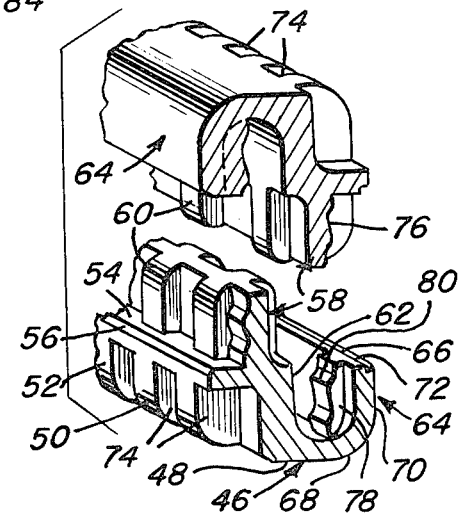
FIG. 10 is a further perspective detail of the handle elements.

Configured in the above manner, the elements 42 and 44, assembled by positioning the panel of each element within the complimentary elongated recess of the other element, and engagement of the lips with the shoulders, as will be best appreciated in FIGS. 9 and 10, define an elongated rod-like handle. This handle, in cross-section, is generally rectangular with rounded edge or corner portions, an opposed pair of which have relatively deep vertical grip enhancing grooves defined therein.

In order to provide for a positive, yet releasable, interlock between the elements 42 and 44, the inner face of each of the panels 58, that face projecting vertically from the shoulder 54, includes, at approximately four points therealong and between adjacent vertical ribs 60, a transverse detent 76. Each detent 76 is slightly below mid height of the panel 58 and is defined by a transverse depression with an immediately overlying smoothly contoured bulge or protrusion. The inner surface of the lip 64, in alignment with the formed detents 76, is formed with an equal number of vertical bars or ribs 78 having inner edges or surfaces configured to define detent mating projections 80, the depth of the bars 78 corresponding to that of the ribs 60 whereby, upon an internesting of the handle elements 42 and 44, a positive interlocking of the projections 80 and detents 76 of the respective elements will be effected. The engagement of the bars 78 between the adjacent ribs 60 will also assist in precluding any longitudinal shifting of the handle elements relative to each other.

Figure 8:
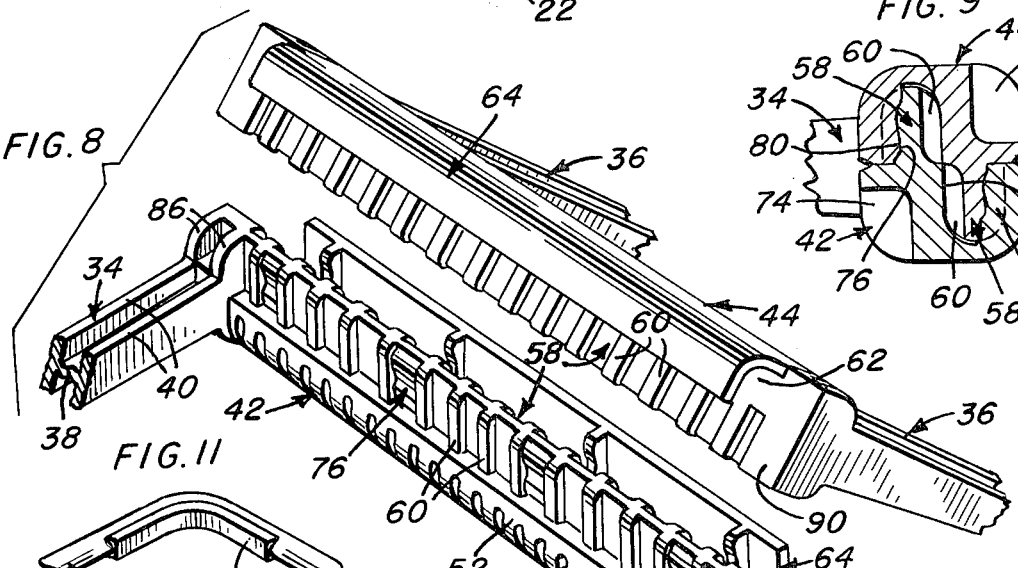
FIG. 8 is a perspective detail of the two handle elements spaced slightly from each other.

Noting FIG. 8 in particular, the straps 34 associated with the handle element 42 engage, and are preferably integrally formed with, block-like structures 82 defined at the opposed ends of the handle element. Each block-like structure 82 includes a lower contoured surface 84 which follows the contour of the surfaces 50 and 52 of the body 46 and constitutes an extension thereof. The upper portion of each structure 82 includes a pair of sector-shaped flanges 86 which are laterally spaced to correspond to the spacing between the adjoining strap flanges 40. The outer wall 88 of each block-like structure 82, constituting the end wall of the handle element 42, defines a planar surface. The arcuate configuration of the sector-like flanges 86 follow the contour of the lip of the second handle element which is engaged immediately adjacent thereto, providing, when the handle elements 42 and 44 are assembled, a continuous construction with each lip 64 nested between the end structures 82 of the opposite handle element. This arrangement will be best noted in FIGS. 1 and 12. It will also be noted that each of the end structures 82 includes a planar vertical face 90 which constitutes a continuation of the outer wall face 62 of the adjoining panel 58 in a common plane with the outer faces of the ribs 60 vertically aligned therewith.

While the above description has been primarily directed to handle element 42, it is to be appreciated that handle element 44 is an exact inverted duplicate thereof. Accordingly, the same reference numerals, for the same component parts, have also been applied to handle element 44, and, the above descriptive matter will be noted to read equally on handle element 44 as on handle element 42. It is contemplated that the carrier 20 preferably be formed by unitary molding or forming from an inherently resiliently flexible and yieldable plastic material. Such may include various polymer and co-polymers as will readily occur to those skilled in the fabrication of plastic articles.

Although formed of a flexible material, the handle elements 42 and 44, and the handle itself resulting from an assembly of the elements, will incorporate a substantial degree of rigidity. This rigidity is achieved through the constructional configuration of the handle elements including the central ribbed partition, the substantially thickened body, and the coextensive spaced lip portion. The straps 34 and 36 are similarly selectively rigidified by the varying thickness side flanges 40 and by the varying width of the straps along the length thereof whereby substantial rigidity is retained adjacent the strap interconnecting handle elements while a high degree of flexure is retained adjacent the container receiving frame 30 at which point the straps are of maximum width with the strap flanges of minimal height.

Figures 4, 5, 6:
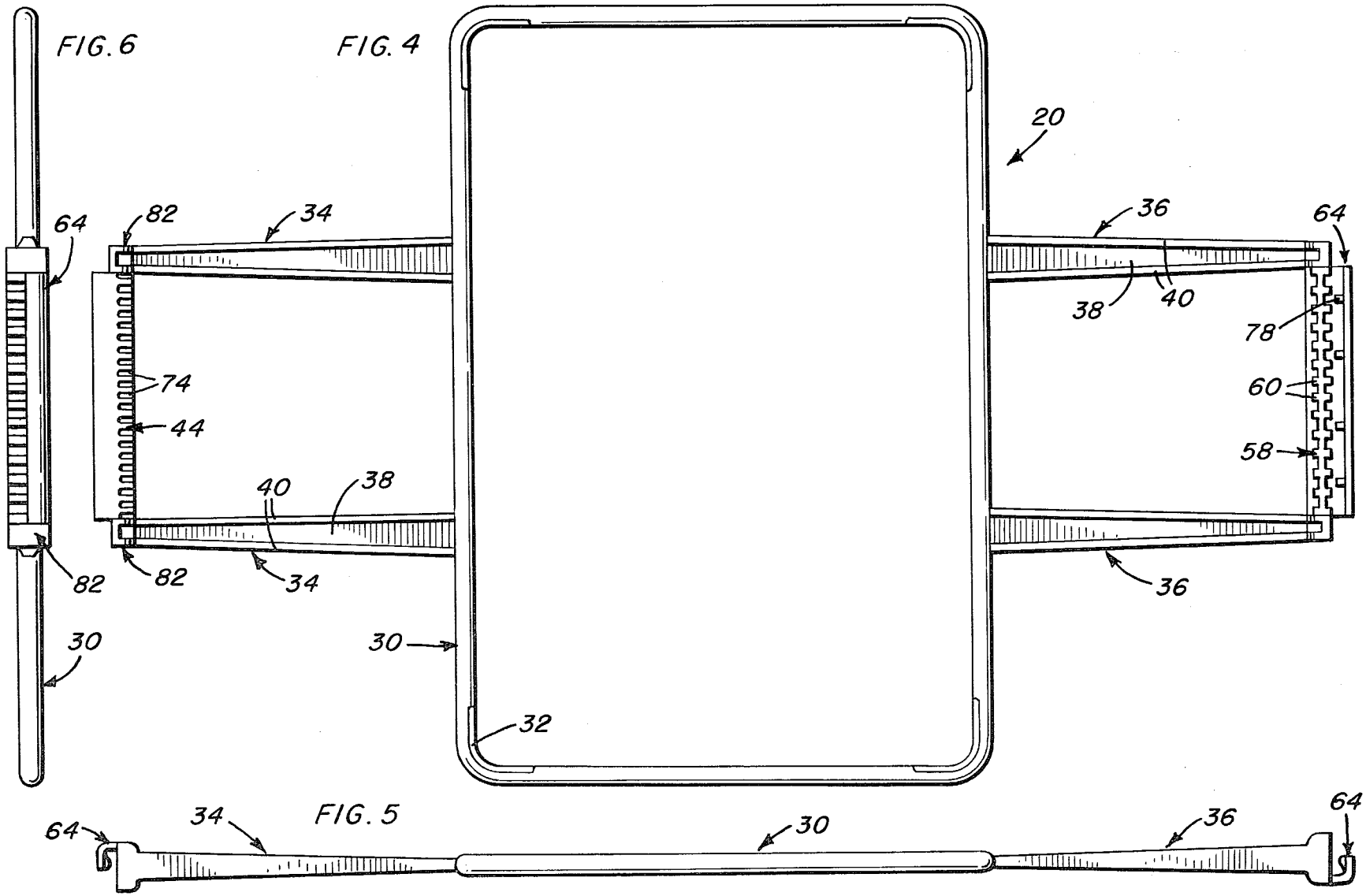
FIG. 4 is a plan view of the carrier with the handle elements released and the handle mounting straps unstressed.
FIG. 5 is a side elevational view of the relaxed carrier of FIG. 4.
FIG. 6 is an end view of the carrier of FIG. 4.

Noting FIGS. 4, 5 and 6, the carrier 20, in its unstressed position, is substantially planar with the straps extending laterally from opposed sides of the frame 30 and the handle elements substantially inverted from their final locked position. Engagement of the carrier 20 with a container 22 is normally effected by an introduction of the container 22 downward through the frame 30 and the frame 30 elevated until intimately engaging with either the tapered side walls 24 of the container or beneath an appropriate container flange 26.

With the frame thus engaged with the container, access to the interior of the container is still readily possible. Similarly, the container closure, as suggested at 28, is also readily removed and replaced with the straps in their outwardly directed unstressed position.

When the container is to be carried, the outwardly directed handle elements are swung upwardly and inwardly, with the straps generally arcuately flexing, to a substantially central position over the received container, at which point the handle elements are snap-interlocked. This is effected, in a manner obvious from the drawings, through a respective engagement of the ribbed panels of each element within the complimentary recess of the other element with the lip of each element moving into abutting engagement with the shoulder of the other element. This movement effects the desired interengagement of the lip mounted projections with the panel formed detents.

Once interlocked, it will be appreciated that the handle elements 42 and 44 define an elongated rigid handle or hand grip through which the carrier and container received therein can be readily carried.

The specific internesting relationship between the locked handle elements, and the inherent enhancement of the detent and projection interengagement as the handle is gripped and elevated, provides for a positive interconnection of the handle elements, precluding any possibility of accidental disengagement. When release of the handle elements is desired, either for facilitating access to the interior of the container or for removal of the carrier, this can be readily effected by appropriate finger and thumb pressure along the adjoining recessed edges 56 and 72 of the abutting lips and shoulders. Upon disengagement of the elements, the resiliency of the straps will tend to move the straps, with the handle elements thereon, outward into the unstressed position.

The foregoing is considered illustrative of the principles of the invention. As modifications and variations may occur to those skilled in the art, it is not desired to limit the invention to the exact construction shown and described. Rather, all suitable modifications and equivalents may be resorted to as fall within the scope of the invention as claimed.

I claim:

1. A carrier for use in the releasable support of a container, said carrier comprising:

a container receiving frame;

first flexible strap means fixed to said frame and extending therefrom to a free end;

second flexible strap means fixed to said frame generally opposed to said first strap means and extending to a free end;

first and second elongate handle elements respectively fixed to the free ends of the first and second strap means, each of said handle elements extending transversely of the corresponding strap means end, each of said handle elements including an elongate rigid body having a first elongate side with first and second opposed edges, and a second elongate side extending from the second of said edges approximately perpendicularly to said first body side, an elongate panel with first and second sides, said panel projecting generally perpendicularly from said first body side in inwardly spaced relation to said first body edge to define a shoulder between the panel and said first body edge, recess defining means laterally to the first panel side comprising an elongate lip extending laterally outward of the second side of the elongate body, said lip including an outer portion generally paralleling said second body side in outwardly spaced relation thereto, said outer portion terminating in an outer edge generally coplanar with said shoulder, said means defining a recess of a size to receive and nest therein the panel of the other handle element whereby said handle elements are adapted for releasable engagement with the panel of each element received within the recess of the other element and said shoulder in seated engagement on the shoulder of the other element;

cooperating releasable lock means on each panel and each recess defining means for releasably locking each panel within the recess receiving this panel;

multiple spaced pairs of rigidifying ribs integral with each panel, the ribs of each pair projecting from the opposed sides of said panel.

2. The carrier of claim 1 wherein said releasable lock means includes at least one detent in each of said panels between a set of adjoining ribs, and at least one projection on the outer portion of each of the lips for selflocking in the detent upon reception of each panel within the recess of the other handle element.

3. The carrier of claim 2 including multiple spaced detents along each panel with multiple complementary projections along each lip outer portion.

4. The carrier of claim 3 wherein said handle elements are inverted duplicates of each other.

5. The carrier of claim 4 wherein each handle element includes bars on the outer portion of the lip, said bars aligning with the detents for engagement between the ribs of each of said sets of adjoining ribs on the other handle element, said projections being formed on said bars.

6. The carrier of claim 5 wherein each strap means comprises a pair of laterally spaced straps extending from said frame to engagement with the corresponding handle element proximate the opposed ends thereof, said straps each varying in width from a maximum width adjacent said frame to a minimum width adjacent the corresponding handle element.

7. The carrier of claim 6 wherein each strap varies in thickness from a minimum thickness adjacent said frame to a maximum thickness adjacent the corresponding handle element.

8. The carrier of claim 7 wherein each strap has an H-shaped cross-sectional configuration comprising a transverse web with opposed inner and outer side flanges.

9. The carrier of claim 8 wherein the elongate panel and lip of each handle element extend between the inner side flanges of the corresponding pair of straps.

10. The carrier of claim 1 wherein the elongate body of each handle element includes third and fourth sides respectively opposed from said first and second sides, and gripping grooves defined in said third and fourth sides at spaced points therealong.

11. The carrier of claim 1 wherein said frame comprises a polygonal container encircling member having interior container engaging corners, said corners being inwardly enlarged and including planar inner faces.

12. The carrier of claim 1 wherein each strap means comprises a pair of laterally spaced straps extending from said frame to engagement with the corresponding handle element proximate the opposed ends thereof, said straps each varying in width from a maximum width adjacent said frame to a minimum width adjacent the corresponding handle element.

13. The carrier of claim 12 wherein each strap varies in thickness from a minimum thickness adjacent said frame to a maximum thickness adjacent the corresponding handle element.

* * * * *